US011306894B2

(12) United States Patent
Cheng

(10) Patent No.: US 11,306,894 B2
(45) Date of Patent: Apr. 19, 2022

(54) OPTICAL ELEMENT AND LIGHT EMITTING DEVICE

(71) Applicant: Lextar Electronics Corporation, Hsinchu (TW)

(72) Inventor: Hsu-Wen Cheng, Hsinchu (TW)

(73) Assignee: Lextar Electronics Corporation, Hsinchu (TW)

( * ) Notice: Subject to any disclaimer, the term of this patent is extended or adjusted under 35 U.S.C. 154(b) by 0 days.

(21) Appl. No.: 17/015,094

(22) Filed: Sep. 9, 2020

(65) Prior Publication Data

US 2021/0190292 A1 Jun. 24, 2021

(30) Foreign Application Priority Data

Dec. 19, 2019 (CN) ..... 201911316954.2

(51) Int. Cl.
*F21V 5/04* (2006.01)
*F21Y 115/10* (2016.01)

(52) U.S. Cl.
CPC ..... *F21V 5/045* (2013.01); *F21Y 2115/10* (2016.08)

(58) Field of Classification Search
CPC ... F21V 5/045; F21V 5/04; F21V 7/04; F21V 19/001; F21Y 2115/10; F21K 9/69
See application file for complete search history.

(56) References Cited

U.S. PATENT DOCUMENTS 7,438,444 B2 * 10/2008 Pao ..... G02B 19/0071 362/327
7,748,873 B2 7/2010 Kim et al.
2009/0129097 A1 * 5/2009 Ewert ..... G02B 19/0028 362/328
2010/0123817 A1 * 5/2010 Liao ..... B29D 11/00365 348/335

(Continued)

FOREIGN PATENT DOCUMENTS

CN 111613713 A * 9/2020
JP 2007-34307 A 2/2007

(Continued)

OTHER PUBLICATIONS

Dr. Aart Statistics » Mean deviation from the mean, Dr. Aart, Internet; 2020 (Year: 2020).*

*Primary Examiner* — Rajarshi Chakraborty
*Assistant Examiner* — Glenn D Zimmerman
(74) *Attorney, Agent, or Firm* — CKC & Partners Co., LLC

(57) ABSTRACT

An optical element includes a bottom surface, a total reflection surface above the bottom surface, a recess recessed from the bottom surface toward the total reflection surface and first and second light exit surfaces. The optical element has a central axis perpendicular to the bottom surface. The total reflection surface has a peripheral boundary away from the central axis. The first light exit surface is connected to the peripheral boundary of the total reflection surface and extends toward the bottom surface away from the central (Continued)

axis. The second light exit surface is connected to the first light exit surface, extends away from the central axis, and is connected to the bottom surface. Each of the first and second light exit surfaces is consisted of at least one linear sub-refractive surface. Each linear sub-refractive surface is a straight line in any cross section passing through the central axis.

15 Claims, 10 Drawing Sheets

(56) References Cited

U.S. PATENT DOCUMENTS

| | | | | |
|---|---|---|---|---|
| 2015/0009680 | A1 | 1/2015 | Chang et al. | |
| 2015/0241020 | A1* | 8/2015 | Lee | G02B 3/02 362/308 |
| 2015/0241620 | A1* | 8/2015 | Wang | G02B 3/08 362/297 |
| 2016/0138776 | A1* | 5/2016 | Joo | G02B 19/0061 362/293 |
| 2016/0312976 | A1* | 10/2016 | Hsu | G02B 6/0001 |
| 2017/0192136 | A1* | 7/2017 | Tsai | G02B 27/1066 |
| 2019/0155009 | A1 | 5/2019 | Ha et al. | |

FOREIGN PATENT DOCUMENTS

| | | | |
|---|---|---|---|
| JP | 2013-516785 | A | 5/2013 |
| JP | 2014-207225 | A | 10/2014 |
| JP | 2019-169420 | A | 10/2019 |

* cited by examiner

OPTICAL ELEMENT AND LIGHT EMITTING DEVICE

RELATED APPLICATIONS

This application claims priority to China Application Serial Number 201911316954.2, filed Dec. 19, 2019, which are herein incorporated by reference.

BACKGROUND

Technical Field

The present disclosure relates to an optical element and a light emitting device with the optical element, and more particularly, to an optical element in which a light exit surface of the optical element includes one or more linear refractive surfaces.

Description of Related Art

Typically, an emission angle for light emitted by a light emitting diode (LED) package is fixed. To meet various requirements for different optical characteristics, an optical lens is usually disposed on the LED package to adjust the illumination profile of the light emitted by the LED package.

For example, the optical lens can be a reflection lens. Light emitted by the LED package can be reflected by a total reflection surface of the reflection lens, and the light refracts out of the optical lens through a light exit surface of the optical lens. However, a conventional light-exit surface design of the optical lens is to control light through curved surfaces, and such a configuration will cause a yellow halo phenomenon to be formed in the illumination profile of the emitted light passing through the curved surfaces, and will further cause a light spot of the light to be small.

SUMMARY

In view of this, the present disclosure provides an optical element and a light emitting module, in which light emitted through the optical element can have a large light spot, and the yellow halo problem of the emitted light can be solved.

One aspect of the present disclosure is related to an optical element. An optical element includes a bottom surface, a total reflection surface, a recess, a first light exit surface and a second light exit surface. The total reflection surface is located above the bottom surface. The optical element has a central axis perpendicular to the bottom surface. The total reflection surface extends outward from the central axis and has a peripheral boundary away from the central axis. The recess is recessed from the bottom surface toward the total reflection surface. The first light exit surface is connected to the peripheral boundary of the total reflection surface and extends toward the bottom surface in a direction away from the central axis. The second light exit surface is connected to the first light exit surface, extends in a direction away from the central axis and connected to the bottom surface. Each of the first light exit surface and the second light exit surface is consisted of at least one linear sub-refractive surface. Each linear sub-refractive surface is a straight line in any cross section passing through the central axis.

In one or more embodiments, at least one of the linear sub-refractive surfaces and the bottom surface has an arithmetic mean deviation greater than 0 μm.

In one or more embodiments, each of the linear sub-refractive surfaces has an arithmetic mean deviation greater than 0 μm. The arithmetic mean deviations are the same as or different from each other.

In one or more embodiments, the arithmetic mean deviation of each linear sub-refractive surface is in a range of 0.5 μm to 40 μm.

In some embodiments, the at least one linear sub-refractive surface of the second light exit surface includes a plurality of the second linear sub-refractive surfaces. The second linear sub-refractive surfaces are connected to each other in sequence from top to bottom and extend from the first light exit surface to the bottom surface.

In some embodiments, each second linear sub-refractive surface is an annular curved surface that is rotationally symmetrical with respect to the central axis. Each annular curved surface has a top boundary and an opposite bottom boundary, and a length of the top boundary is less than or equal to a length of the bottom boundary.

In one or more embodiments, each second linear sub-refractive surface is an annular curved surface that is rotationally symmetrical with respect to the central axis. Each annular curved surface has a top boundary and an opposite bottom boundary, and a distance between the top boundary and the central axis is less than or equal to a distance between the bottom boundary and the central axis.

In one or more embodiments, each second linear sub-refractive surface has an included angle with respect to the bottom surface, and the included angles are less than or equal to 90 degrees.

In one or more embodiments, the included angles of the second linear sub-refractive surface gradually increase from the first light exit surface to the bottom surface from top to bottom.

In one or more embodiments, the at least one linear sub-refractive surface includes a plurality of the first linear sub-refractive surfaces, the first linear sub-refractive surfaces are connected to each other in order from top to bottom to connect the total reflection surface and the second light exit surface. Each of the first linear sub-refractive surfaces extends in a direction away from the central axis.

In one or more embodiments, the total reflection surface has a plurality of convex structures, and the convex structures are used to destroy the total reflection mechanism.

In one or more embodiments, each linear sub-refractive surface is an annular curved surface that is rotationally symmetrical with respect to the central axis.

In one or more embodiments, the total reflection surface is concave toward the bottom surface.

On aspect of the present disclosure is related to a light emitting device. The light emitting device includes a driving substrate, a light emitting element and an optical element mentioned above. The light emitting element is disposed on the driving substrate. The optical element is disposed on the driving substrate, wherein the recess of the optical element is used for accommodating the light emitting element.

In one or more embodiments, the light emitting element comprises a light emitting diode.

In summary, each light exit surface of the optical element of the present disclosure is consisted of at least one linear sub-refractive surface. By controlling the slope and length of each linear sub-refractive surface, the halo phenomenon can be effectively solved and the size of the light spot can be increased.

The above description is only used to explain the problems to be solved by the present disclosure, the technical means for solving the problems and the produced effects.

The specific details of the present disclosure are described in detail in the following embodiments and related drawings.

BRIEF DESCRIPTION OF THE DRAWINGS

The drawings disclose one or more embodiments of the present disclosure and, together with the explanation in the description, serve to explain the principles of the present disclosure. Wherever possible, the same reference numbers will be used throughout the drawings to refer to the same or like elements in the embodiments. These drawings include.

DETAILED DESCRIPTION

The following embodiments are disclosed with accompanying diagrams for a detailed description. For illustration clarity, many details are explained in the following description. However, it should be understood that these details do not limit the present disclosure. That is, these details are not necessary in parts of embodiments of the present disclosure. Furthermore, for simplifying the drawings, some of the conventional structures and elements are shown with schematic illustrations. Also, the same labels may be regarded as the corresponding components in the different drawings unless otherwise indicated. The drawings are drawn to clearly illustrate the connection between the various components in the embodiments, and are not intended to depict the actual sizes of the components.

In addition, terms used in the specification and the claims generally have their usual meaning as used in the field, in the context of the disclosure and in the context of the particular content unless particularly specified otherwise. Some terms used to describe the disclosure are discussed below or elsewhere in the specification to provide additional guidance related to the description of the disclosure to those in the art.

The phrases "first," "second," etc., are solely used to separate the descriptions of elements or operations with the same technical terms, and are not intended to convey a meaning of order or to limit the disclosure.

Additionally, the phrases "comprising," "includes," "provided," and the like, are all open-ended terms, i.e., meaning including but not limited to.

Further, as used herein, "a" and "the" can generally refer to one or more unless the context particularly specifies otherwise. It will be further understood that the phrases "comprising," "includes," "provided," and the like used herein indicate the stated characterization, region, integer, step, operation, element and/or component, and does not exclude additional one or more other characterizations, regions, integers, steps, operations, elements, components and/or groups thereof.

Figure 1:
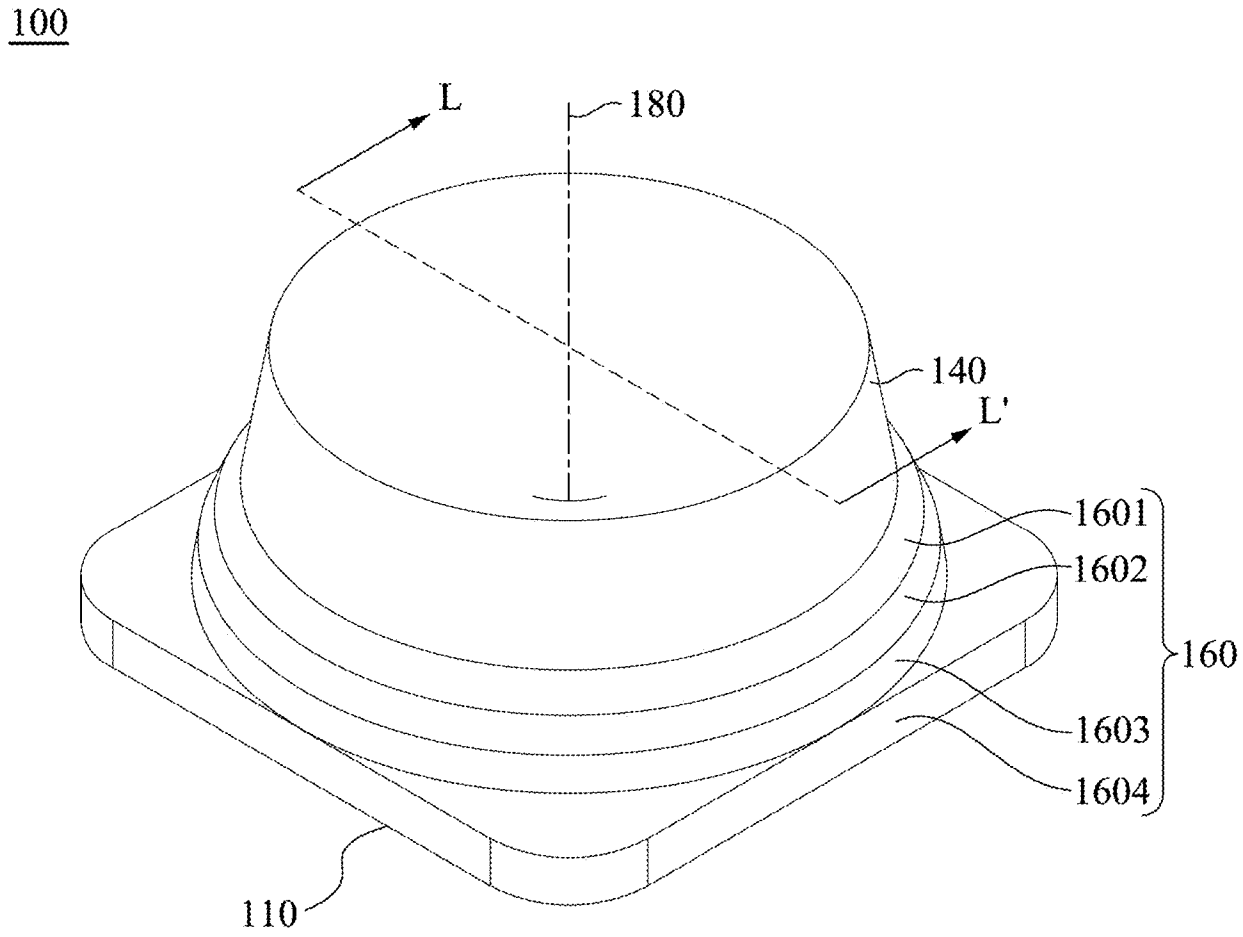
FIG. 1 illustrates a perspective view of an optical element according to one embodiment of the present disclosure.

Reference is made to FIG. 1. FIG. 1 illustrates a perspective view of an optical element 100 according to one embodiment of the present disclosure. In this embodiment, the optical element 100 is a type of an optical lens, and a light emitting element can be configured within the optical element 100. When the light emitting element within the optical element 100 emits light, a part of the light emitted by the light emitting device is transmitted from the above of the optical element 100, and another part of the light emitted by the light-emitting element can be refracted by a light exit surface of the optical element 100.

As shown in FIG. 1, the optical element 100 has a bottom surface 110, and light exit surfaces disposed on the bottom surface 110. The light exit surfaces include a first light exit surface 140 and a second light exit surface 160. In the present disclosure, each of the first light exit surface 140 and the second light exit surface 160 is consisted of one or more linear sub-refractive surface. In this embodiment, the first light exit surface 140 is consisted of one linear refractive surface, and the second light exit surface 160 is consisted of several linear sub-refractive surfaces, which include linear sub-refractive surfaces 1601, 1602, 1603 and 1604.

Figure 2:
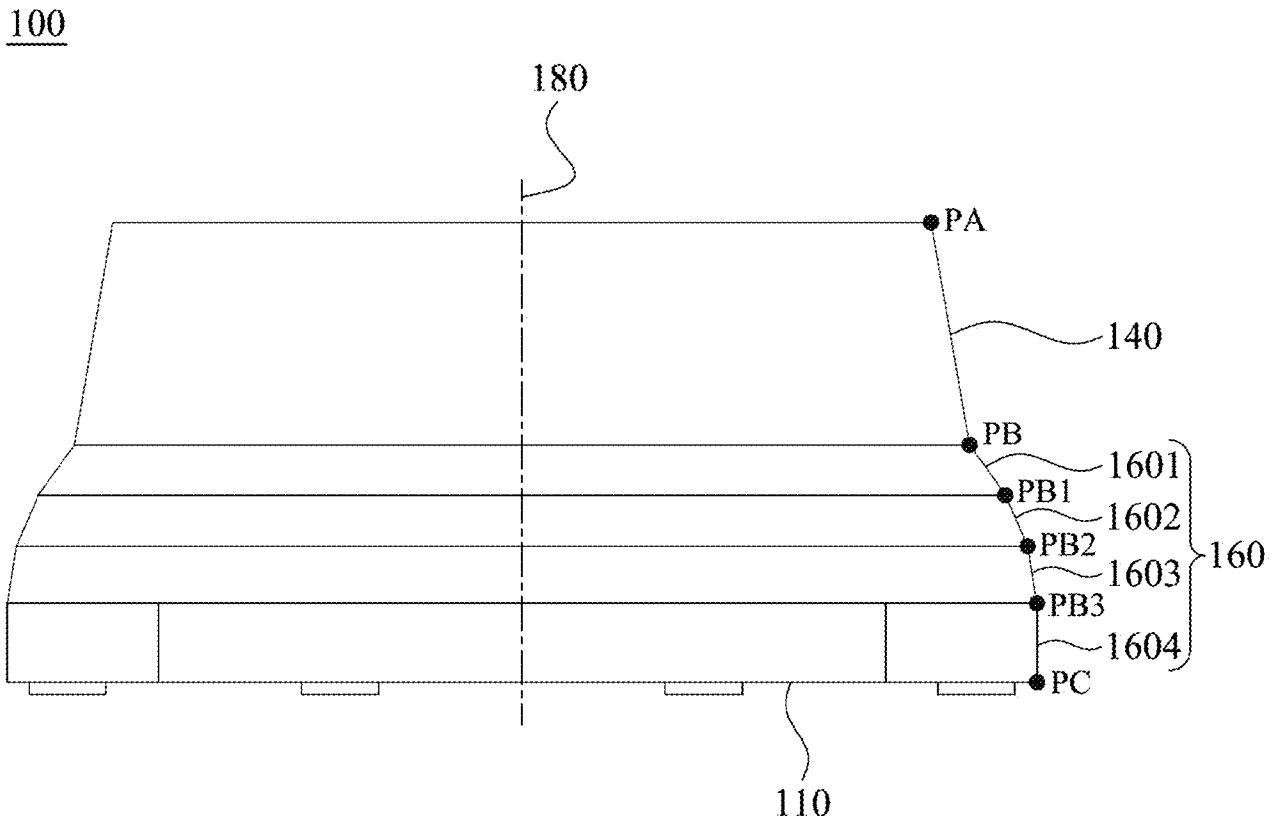
FIG. 2 illustrates a side view of the optical element of FIG. 1.

FIG. 2 illustrates a side view of the optical element 100 of FIG. 1. In the side view of the optical element 100 in FIG. 2, the linear refractive surface of the first light exit surface 140 and the linear sub-refractive surfaces 1601, 1602, 1603 and 1604 forming the second light exit surface 160 are all shown as a straight line.

Referring back to FIG. 1, in this embodiment, the optical element 100 shown in FIG. 1 has a central axis 180, which is substantially perpendicular to the bottom surface 110. Reflection surfaces and the refractive surfaces are configured with reference to the central axis 180. For example, in this embodiment, the optical element 100 is rotationally symmetrical with respect to the central axis 180, and each linear sub-refractive surface (e.g., the linear sub-refractive surfaces 1601, 1602, 1603 and 1604) is substantially an annular curved surface, in which the annular linear sub-refractive surfaces are rotationally symmetrical with respect to the central axis 180. In some embodiments, the optical element 100 can be rotationally non-symmetrical with respect to the central axis 180.

Figure 3:
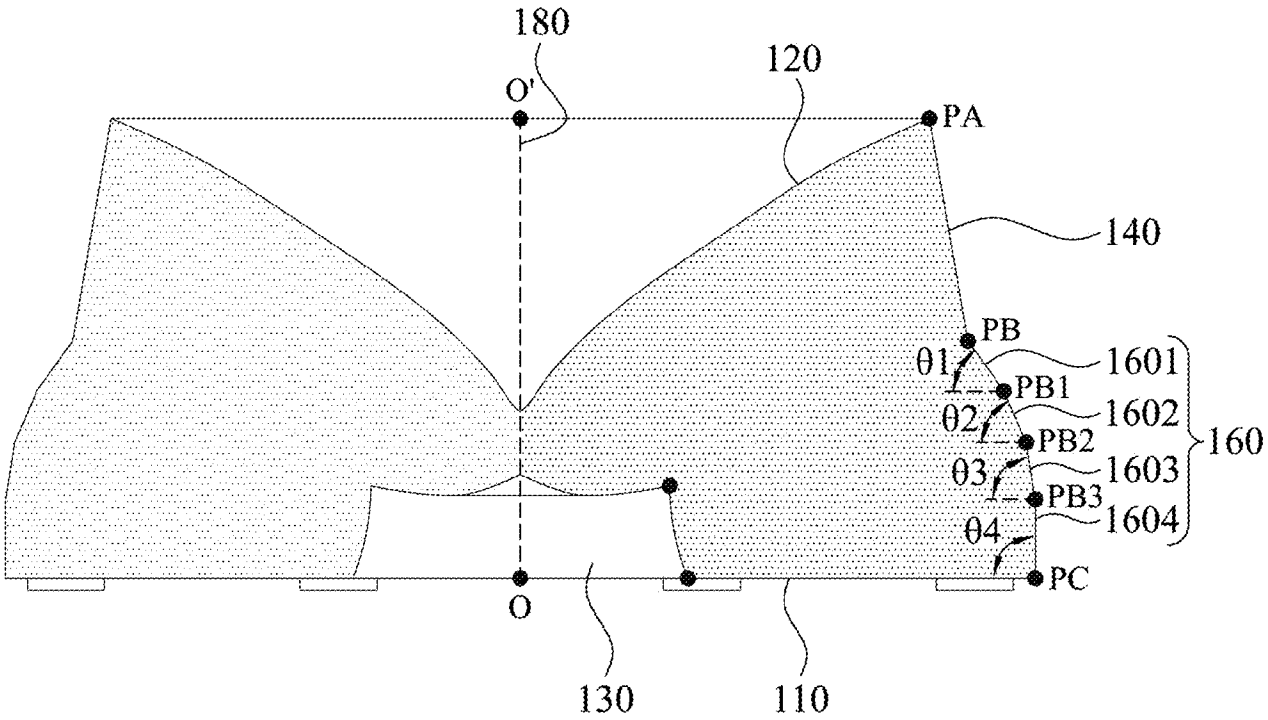
FIG. 3 illustrates a cross-sectional view of the optical element of FIG. 1 along line L-L'.

To further explain the structure of the optical element 100, reference is made to FIG. 2 and FIG. 3. FIG. 3 illustrates a cross-sectional view of the optical element 100 of FIG. 1 along line L-L'. Line L-L' passes through the central axis 180. As shown in FIG. 3, the optical element 100 includes the bottom surface 110, a total reflection surface 120, a recess 130, the first light exit surface 140 and the second light exit surface 160. The central axis 180 of the optical element 100 passes through a center point O on the bottom surface 110 and is perpendicular to the bottom surface 110. As shown in FIG. 3, the central axis 180 can be regarded as a line O-O' passing through the center point O.

The total reflection surface 120 is located above the bottom surface 110. The total reflection surface 120 extends outward from the central axis 180 and has a peripheral boundary away from the central axis 180. A vertex PA is located on the peripheral boundary of the total reflection surface 120. In this embodiment, the total reflection surface 120 is concave toward the bottom surface 110. The first light exit surface 140 is connected to the peripheral boundary of the total reflection surface 120, and extends toward the bottom surface 110 in a direction away from the central axis 180. The first light exit surface 140 is connected to the second light exit surface 160 and does not contact the bottom surface 110. The second light exit surface 160 is connected to the first light exit surface 140, also extends in a direction away from the central axis 180 and is connected to the bottom surface 110.

As mentioned above, the second light exit surface 160 includes the linear sub-refractive surfaces 1601, 1602, 1603 and 1604. Since line L-L' passes through the central axis 180, the cross-sectional view of the optical element 100 in FIG. 3 illustrates a cross-section extending through the central axis 180. Therefore, in this embodiment, each linear sub-refractive surface (e.g., linear sub-refractive surfaces 1601, 1602, 1603 and 1604) on the cross-section shown in FIG. 3 is a straight line. In other words, in this embodiment, the light exit surface is no longer consisted of one or more curved surface, but is consisted of at least one linear sub-refractive surface which is straight on a cross-section extending through the central axis 180.

Reference is made back to FIG. 2. Specifically, the two borders of one of the linear sub-refractive surfaces and any adjacent linear sub-refractive surfaces respectively correspond to a top boundary and a bottom boundary. Vertices are located on the top boundaries and the bottom boundaries. To explain the configurations of the linear sub-refractive surfaces through the vertices, labels of the vertices are as defined below. As shown in FIG. 2, a vertex PA is on the top boundary of the first light exit surface 140. The top boundary of the first light exit surface 140 corresponds to the extending peripheral boundary of the total reflection surface 120 as shown in FIG. 3. A vertex PB is located on the boundary between the first light exit surface 140 and the second light exit surface 160. In other words, the vertex PB is located on the bottom boundary of the first light exit surface 140 and the top boundary of the second light exit surface 160. A vertex PC is located on the boundary between the bottom surface 110 and the second light exit surface 160. That is, the boundary between the bottom surface 110 and the second light exit surface 160 can be regarded as the bottom boundary of the second light exit surface 160.

Figure 8:
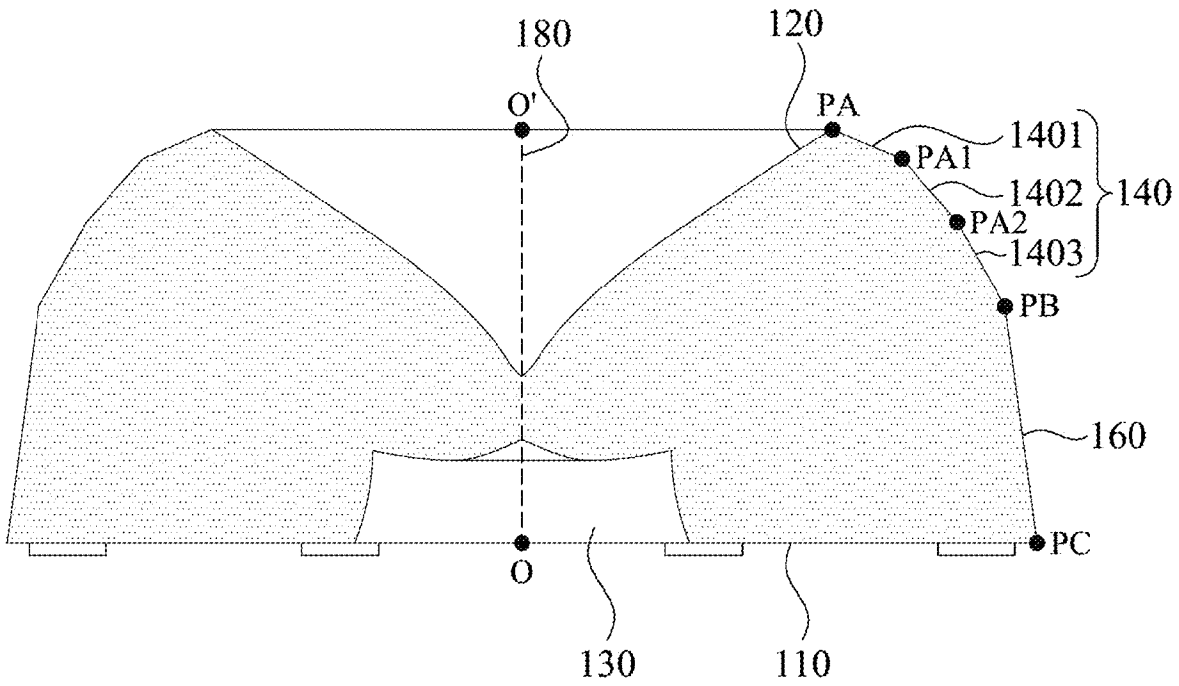

In this embodiment, since the second light exit surface 160 is consisted of a plurality of linear sub-refractive surfaces, a plurality of vertices is located on the borders of the linear sub-refractive surfaces. For example, on the border of the linear sub-refractive surfaces 1601 and 1602, a corresponding vertex PB1 is located on the bottom boundary of the linear sub-refractive surface 1601 and the top boundary of the linear sub-refractive surface 1602. Counting from top to bottom, the border of the linear sub-refractive surfaces 1601 and 1602 is the first boundary on the second light exit surface 160, and the vertex on the first boundary is defined as the vertex PB1. Similarly, a plurality of boundaries are encountered from the second light exit surface 160 to the bottom surface 110 from top to bottom, and these can be sequentially labeled as a vertex PB2 and a vertex PB3. Similar marking rules can also be applied when the first light exit surface 140 is consisted of multiple linear sub-refractive surfaces from the top boundary of the first light exit surface 140 to the bottom boundary of the first light exit surface 140 from top to bottom. The vertices on these boundaries can be labeled as vertex PA1, vertex PA2, and so on in sequence, as shown in FIG. 8 below.

Therefore, in the cross-section along line L-L' as shown in FIG. 3, the first light exit surface 140 corresponds to the line PA-PB. The second light exit surface 160 is consisted of a plurality of the linear sub-refractive surfaces including the linear sub-refractive surface 1601 corresponding to line PB-PB1, the linear sub-refractive surface 1602 corresponding to line PB1-PB2, the linear sub-refractive surface 1603 corresponding to line PB2-PB3 and the linear sub-refractive surface 1604 corresponding to line PB3-PC. The linear sub-refractive surfaces 1601, 1602, 1603 and 1604 forming the second light exit surface 160 are sequentially connected from the bottom boundary of the first light emitting surface 140 from top to bottom and extend to the bottom surface 110. In the cross-section shown in FIG. 3, the vertex PB is connected to vertex PB1, the vertex PB1 connected to the vertex PB2, the vertex PB2 is connected to the vertex PB3, and the vertex PB3 is connected to the vertex PC. The distances between the central axis 180 and the vertex PB, the vertex PB1, the vertex PB2, the vertex PB3, and the vertex PC sequentially get farther and farther.

In this embodiment, the optical element 100 is rotationally symmetric with respect to the central axis 180, and the linear sub-refractive surfaces 1601, 1602, 1603 and 1604 are substantially annular curved surfaces that are rotationally symmetric with respect to the central axis 180. For example, for the linear sub-refractive surface 1602, the vertex PB1 is located on the top boundary of the linear sub-refractive surface 1602, and the vertex PB2 is located on the bottom boundary linear sub-refractive surface 1602. Since the distance from the vertex PB1 to the central axis 180 is less than the distance from the vertex PB2 to the central axis 180, the length of the top boundary of the linear sub-refractive surface 1602 is less than the length of the bottom boundary.

As shown in FIG. 3, in this embodiment, the linear sub-refractive surfaces 1601, 1602, 1603 and 1604 respectively have included angles 81, 82, 83 and 84 with respect to the bottom surface 110 in a horizontal direction. The included angles 81, 82, 83 and 84 can be less than or equal to 90 degrees, such that the second light exit surface 160 is not concave toward the central axis 180, which is beneficial for the fabrication of the optical element 100. In this embodiment, the included angle θ1, the included angle θ2, the included angle θ3 and the included angle θ4 increase gradually from the first light exit surface 140 to the bottom surface 110 from top to bottom. In other words, the included angle θ4 is greater than the included angle θ3, the included angle θ3 is greater than the included angle θ2, and the included angle θ2 is greater than the included angle θ12. Therefore, the second light exit surface 160 does not have discontinuous changes. The shape of the second light exit surface 160 can be similar to a curved surface. However, compared with a curved optical lens composed by curved surfaces, such a configuration of the present disclosure allows for easy adjustment to the shape of the second light exit surface 160, and the optical element can respond to different light emitting elements. As shown in FIG. 3, the included angles 81, 82 and 83 are less than 90 degrees. When the linear sub-refractive surface 1604 extends to the bottom surface 110, the included angle θ4 of the linear sub-refractive surface 1604 can be close to 90 degrees. In this embodiment, the included angle θ4 is equal to 90 degrees, which is similar a situation in which a semicircular surface meets a plane. Therefore, the distance from the vertex PB3 of the linear sub-refractive surface 1604 to the central axis 180 is substantially equal to the distance from the bottom vertex PC to the central axis 180. That is, a length of the top boundary of the linear sub-refractive surface 1604 is substantially equal to a length of the bottom boundary.

The advantage of forming a light exit surface (for example, the first light exit surface 140 and the second light exit surface 160) by a plurality of linear sub-refractive surfaces is that it is easy to adjust parameters in manufacturing different light emitting elements. Compared with a curved surface, only the lengths of the linear sub-refractive surfaces in cross-section and the included angle between the linear sub-refractive surface and the bottom surface 110 need to be adjusted when the light exit surface is formed by the linear sub-refractive surfaces. Further, with respect to optical simulation, the light exit surface consisted of the linear sub-refractive surfaces allows for easy adjustment of parameters to adapt to different situations.

Accordingly, when a light emitting element provided inside the optical element 100 emits light, an improved illumination profile can be obtained. The light emitting element provided in the recess 130 of the optical element 100 (shown in FIG. 10 below) emits light. Part of the light is reflected by the total reflection surface 120 to the first light exit surface 140 and then refracted by the first light exit surface 140 to exit the lens, and part of the light is directly refracted by a plurality of linear sub-refraction surfaces of the second light emitting surface 160 to exit the lens. Part of the light may also be reflected inside the optical element 100 and interfere with each other to affect the illumination profile.

Figure 4:
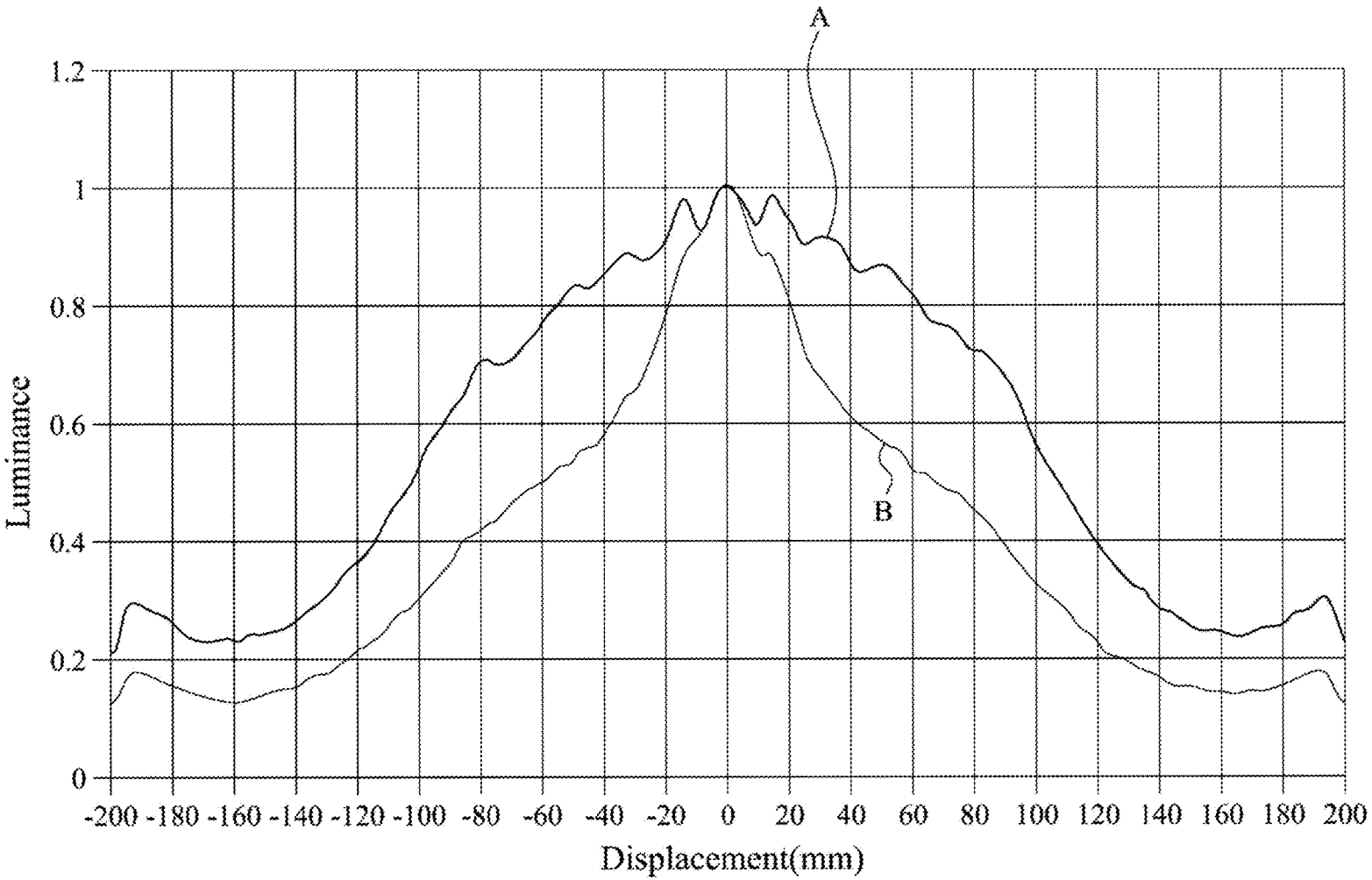
FIG. 4 illustrates a relationship between the luminance and the displacement of an optical element of the present disclosure and a curved surface optical lens.
Figure 5B:
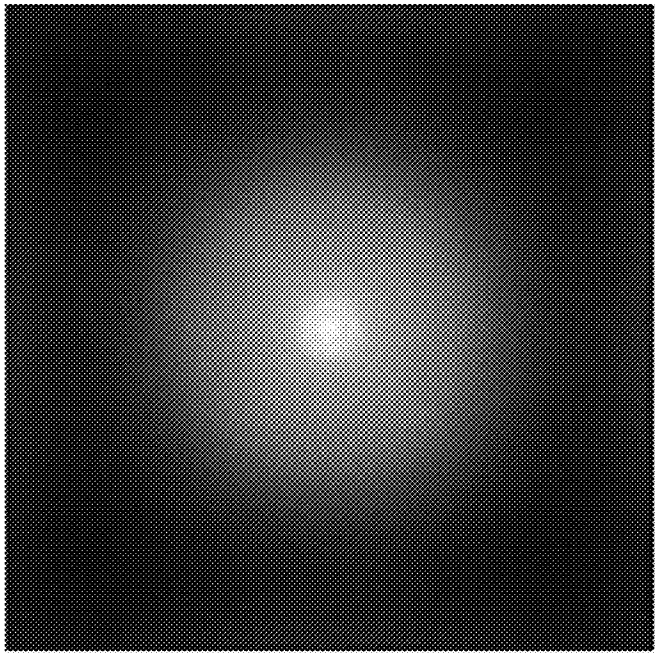
FIG. 5B illustrates an illumination profile of the curved surface optical lens.
Figure 5A:
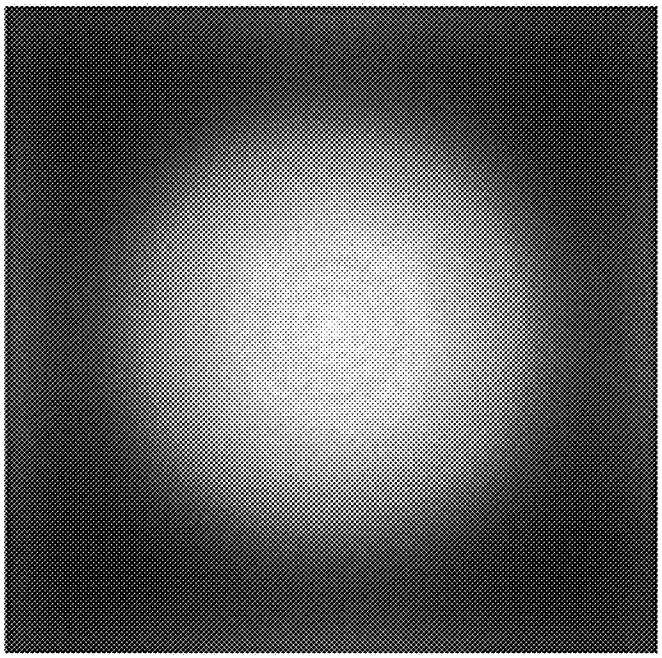
FIG. 5A illustrates an illumination profile of the optical element of the present disclosure.

Reference is made to FIG. 4, FIG. 5A and FIG. 5B. FIG. 4 illustrates a relationship between the luminance and the displacement of the optical element 100 of the present disclosure and a curved surface optical lens. FIG. 5A illustrates an illumination profile of the optical element 100 of the present disclosure. FIG. 5B illustrates an illumination profile of the curved surface optical lens. In this embodiment, the light is projected from above the optical element 100 by the arrangement of the optical element 100, and is shown as a curve A in FIG. 4. For comparison, a curved optical lens is shown as a curve B in FIG. 4, and the curve B corresponds to the illumination profile of FIG. 5B. In FIG. 4, the displacement refers to the distance from the center of the illumination profile, and the unit of the displacement is mm. Luminance refers to the corresponding luminous intensity, and the maximum luminous intensity obtained is normalized, so there is no unit on the vertical axis. As shown in FIG. 4, the luminance of the illumination profile generated by the optical element 100 of the present disclosure is obviously greater than the luminance of the illumination profile generated by the curved optical lens. For the illumination profiles shown in FIGS. 5A and 5B, the range of the illumination profile in FIG. 5A is enlarged by a significant degree, and the size of the spot is increased.

In some embodiments, the arithmetic mean deviations of the bottom surface 110 and the linear sub-refractive surfaces forming the first light exit surface 140 and the second light exit surface 160 can be different. That is, the bottom surface 110 and the linear sub-refractive surfaces can have arithmetic mean deviations greater than zero, so as to destroy the interference of the light refracted from the linear refraction surfaces or reflected by the bottom surface 110, and the illumination profile is affected. Furthermore, different linear sub-refractive surfaces can be designed with arithmetic mean deviations that are the same as or different from each other. This can be regarded as a kind of roughening treatment. In some embodiments, the arithmetic mean deviations of the linear sub-refractive surfaces can be designed to be in the range between 0.5 μm and 40 μm.

When there is no roughening treatment on the bottom surface 110 or the linear sub-refractive surfaces, the distribution of the illumination profile from the optical element 100 becomes larger. The roughening treatment on the bottom surface 110 and a part of the second light emitting surface 160 is used to suppress the distribution of yellow halo of the illumination profile. Compared with the conventional curved optical lens, the light emitted through the optical element 100 can be controlled to have an illumination profile with a large size. Moreover, the yellow halo of the large illumination profile is not obvious, and the yellow halo phenomenon of the light is reduced.

In some embodiments, a plurality of convex structures can be provided on the total reflection surface 120. These convex structures can destroy the total reflection mechanism and improve the brightness near the central axis 180 of the optical element 100. In some embodiments, the range of the curvature of each convex structure can be in the range from 0.2 μm to 2 μm, and the curvature of each convex structure can be different. In some embodiments, the curvatures of each convex structure can be the same.

FIGS. 6-9 respectively illustrate cross-sectional views of different optical elements of the present disclosure.

Figure 6:
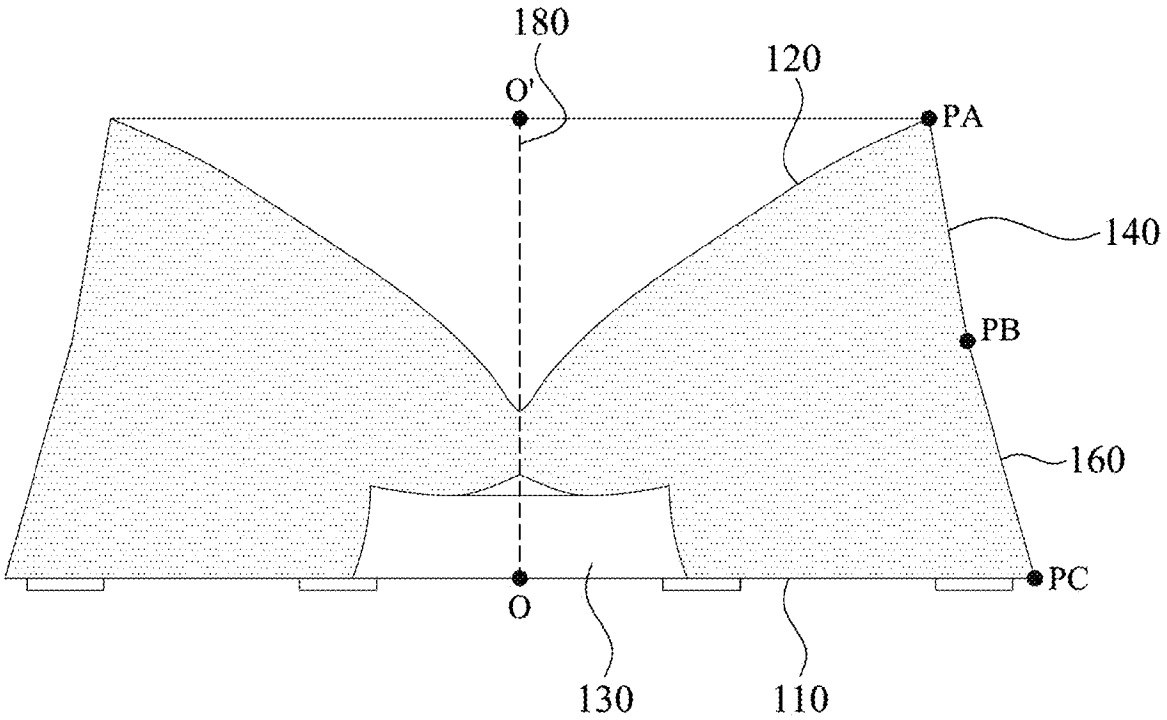
FIGS. 6-9 respectively illustrate cross-sectional views of different optical elements of the present disclosure.

FIG. 6 illustrates a simple example of the optical element of the present disclosure. Each of the first light exit surface 140 and the second light exit surface 160 of the optical element shown in FIG. 6 is consisted of one linear refractive surface.

Figure 7:
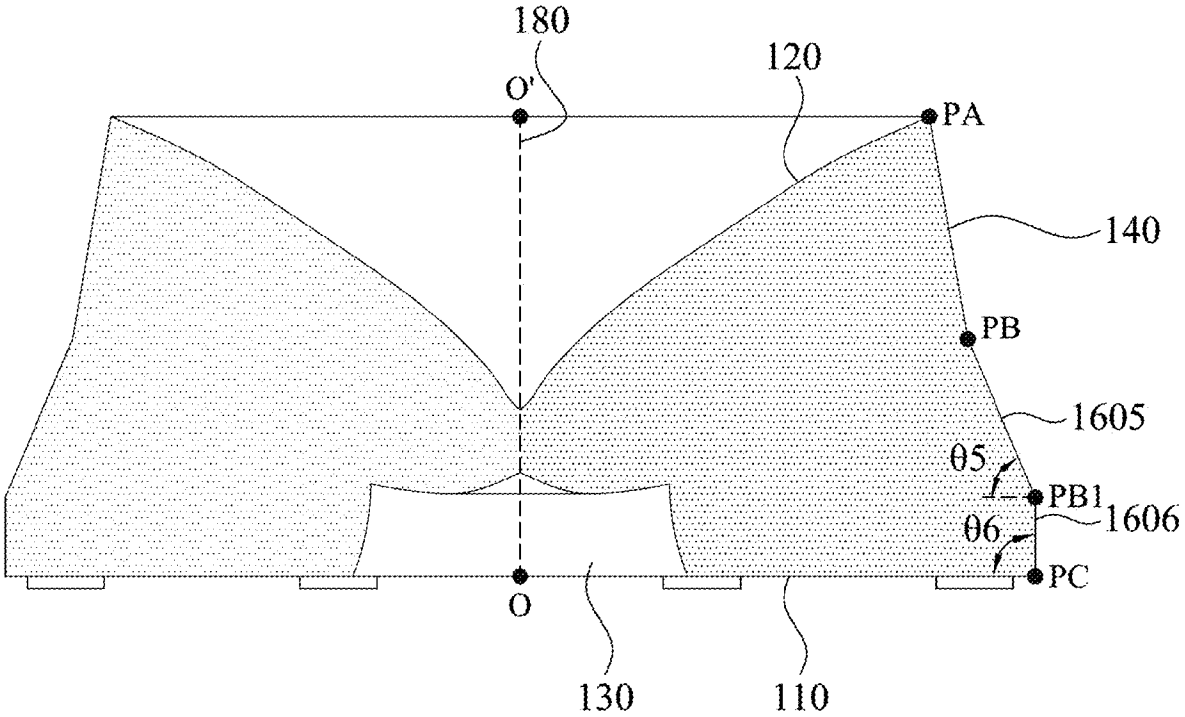

FIG. 7 illustrates another example of the optical element of the present disclosure. Compared with the optical element 100 shown in FIG. 3, the second light exit surface 160 of the optical element in FIG. 7 is consisted of two linear sub-refractive surfaces 1605 and 1606. An included angle θ5 is formed between the linear sub-refractive surface 1605 and the bottom surface 110 in the horizontal direction. An included angle θ6 is formed between the linear sub-refractive surface 1606 and the bottom surface 110 in the horizontal direction. The included angle θ5 is less than the included angle θ6, indicating a reduction in included angle in a direction from top to bottom.

In addition, the included angles 85 and 86 can be less than 90 degrees or substantially equal to 90 degrees. As shown in FIG. 7, the included angle θ5 is less than 90 degrees and the included angle θ6 is close to 90 degrees or substantially equal to 90 degrees. Therefore, the distance between the vertex PB of the linear sub-refractive surface 1605 and the central axis 180 is less than the distance from the central axis 180 to the vertex PB1. In other words, the length of the top boundary of the linear sub-refractive surface 1605 is less than the length of the bottom boundary of the linear sub-refractive surface 1605. For the linear sub-refractive surface 1606, the distance from the central axis 180 to the vertex PB1 on the top boundary is substantially equal to the distance from the central axis 180 to the vertex PC on the bottom boundary. Therefore, the length of the top boundary of the linear sub-refractive surface 1606 is substantially equal to the length of the bottom boundary of the linear sub-refractive surface 1606.

FIG. 8 illustrates an example of an optical element according to another embodiment of the present disclosure. Compared with the optical element 100 shown in FIG. 3, the second light exit surface 160 of the optical element in FIG. 8 is a linear sub-refractive surface, and the first light exit surface 140 is consisted of a linear sub-refractive surface 1401 (corresponding to line PA-PA1 in cross-section), a linear sub-refractive surface 1402 (corresponding to line PA1-PA2 in cross-section) and a linear sub-refractive surface 1403 (corresponding to line PA2-PB in cross-section). These linear sub-refractive surfaces 1401-1403 are sequentially connected from the boundary of the total reflection surface 120 from top to bottom in order to extend to the top boundary of the second light exit surface 160. Vertex PA is located on the boundary between the total reflection surface 120 and the linear sub-refractive surface 1401, vertex PA1 is located on the boundary between the linear sub-refractive surfaces 1401 and 1402, and vertex PA2 is located on the boundary between the linear sub-refractive surfaces 1402 and 1403. In addition, the included angle between the linear sub-refractive surfaces 1401-1403 and the bottom surface 110 in the horizontal direction gradually increases from top to bottom.

Figure 9:
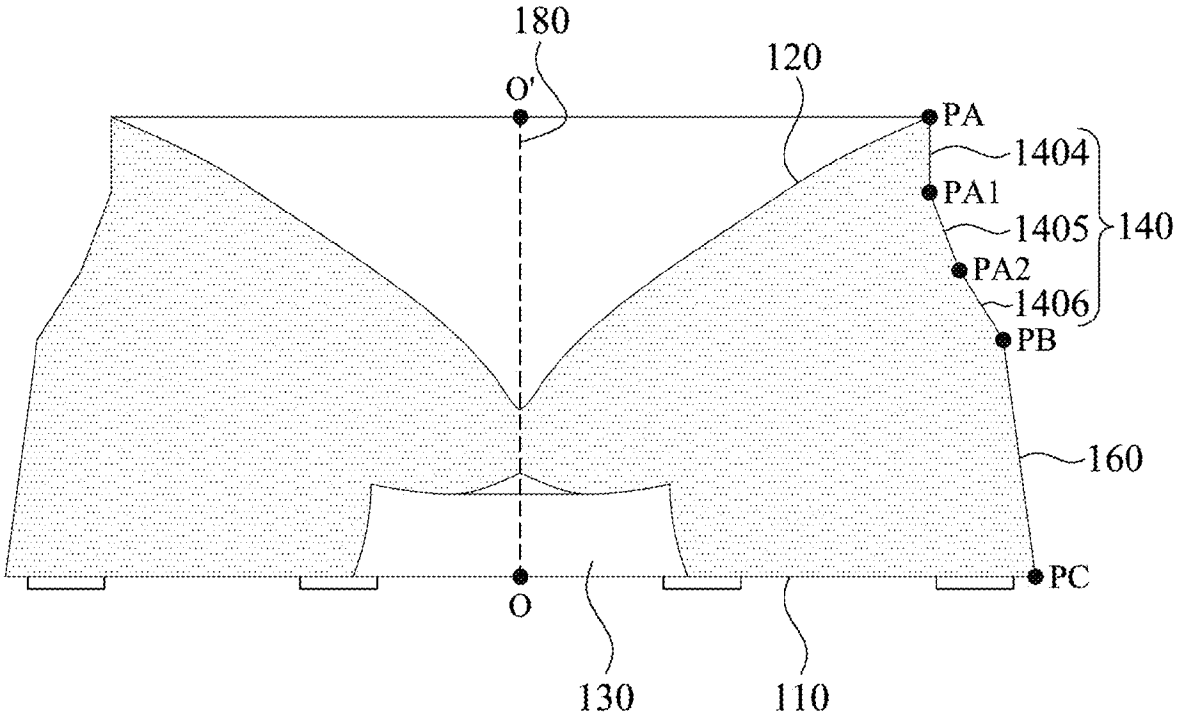

FIG. 9 illustrates an example of the optical element of another embodiment of the present disclosure. Compared with the optical element shown in FIG. 8, the first light exit surface 140 of the optical element shown in FIG. 9 is consisted of the linear sub-refractive surfaces 1404, 1405 and 1406. The horizontal included angle between the bottom surface 110 and the linear sub-refractive surfaces 1404, 1405 and 1405 gradually decreases from top to bottom.

Figure 10:
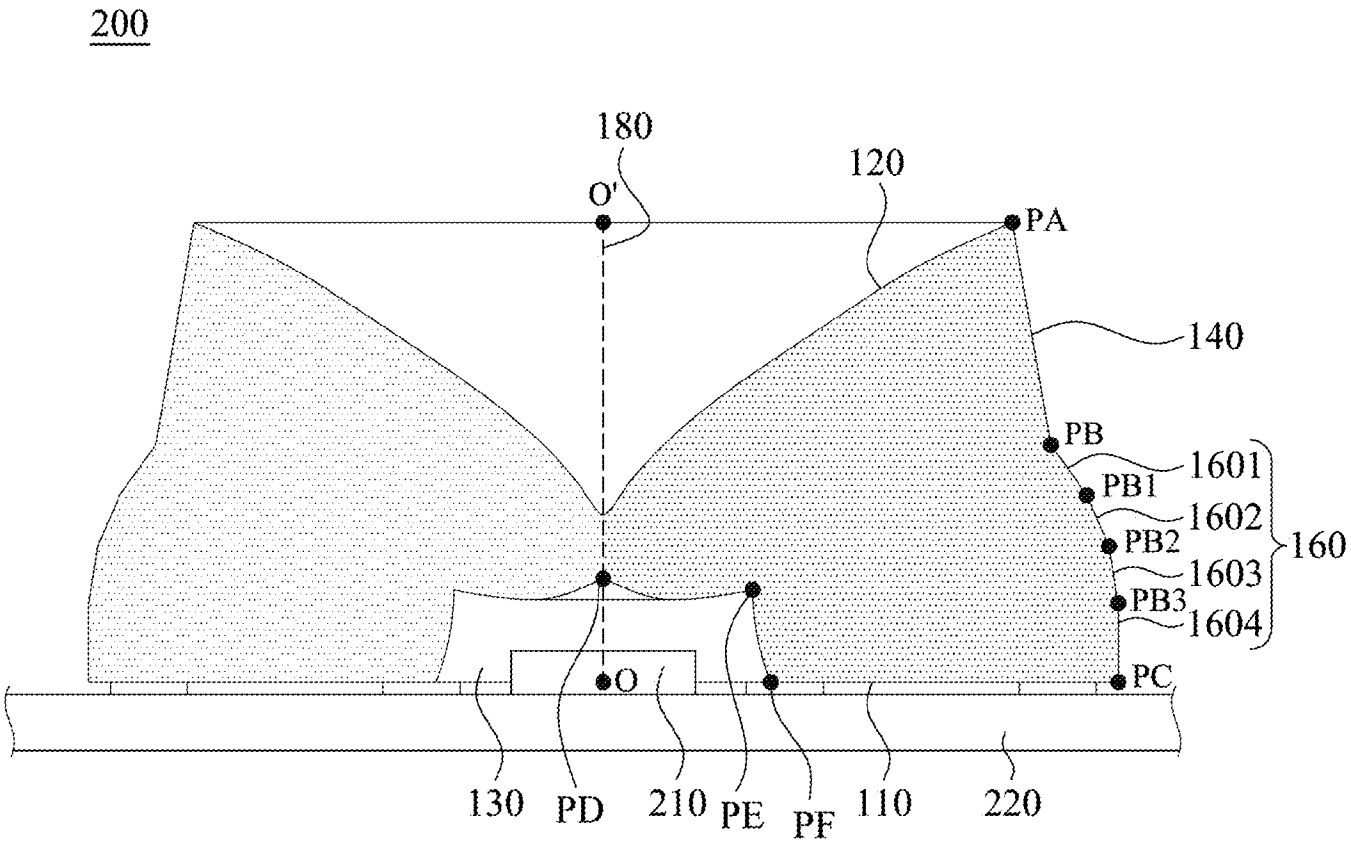
FIG. 10 illustrates a cross-sectional view of a light emitting device of the present disclosure.

FIG. 10 illustrates a cross-section of a light emitting device of the present disclosure. As shown in FIG. 10, the light emitting device 200 includes the optical element 100 mentioned above, a driving substrate 220 and a light emitting element 210. The recess 130 of the light element 100 is used for accommodating the light emitting element 210. The driving substrate 220 is connected to the light emitting element 210, and the driving substrate 220 drives the light emitting element 210. In some embodiments, the light emitting element 210 includes a light emitting diode. In some embodiments, the light emitting diode can be a light emitting diode (LED) chip, a mini LED chip or a micro LED chip. In some embodiments, the light emitting diode can include a package with at least one LED chip.

In the light-emitting device 200, when the light emitting element 210 is driven to emit light, the light is emitted through the top and side surfaces of the recess 130. Part of the light is emitted from the surface of the line PD-PE. Part of the emitted light is reflected by the total reflection surface 120 to the first light exit surface 140 and refracted from the first light light exit surface 140 to exit the lens. At the same time, part of the light can directly reach the second light exit surface 160 through the side corresponding to the line segment PE-PF on the recess 130, and this light is refracted through the second light exit surface 160 consisted of a plurality of linear sub-refraction surfaces 1601-1604.

In summary, the optical element of the present disclosure includes first and second light exit surfaces. Each of the first and second light exit surfaces is consisted of one or more linear sub-refractive surfaces. The linear sub-refractive surfaces from the total reflection surface to the bottom surface are formed extending outwards from top to bottom. Since the first and second light exit surfaces of the optical element are consisted of linear sub-refractive surfaces, the optical element of the present disclosure is not only conveniently manufactured, but also requires only a few parameters to adjust the linear sub-refractive surfaces, which is convenient for optical simulation before manufacturing. This not only reduces the manufacturing cost but also reduces the spot size simply and effectively. At the same time, it can be also possible to set different arithmetic mean deviations for different linear sub-refractive surfaces of the optical element, thereby improving the yellow halo phenomenon.

The foregoing has described features of several embodiments so that those skilled in the art may better understand the description in various aspects. It will be apparent to those skilled in the art that various modifications and variations can be made to the structure of the embodiments of the present disclosure without departing from the scope or spirit of the present disclosure. In view of the foregoing, it is intended that the present disclosure cover modifications and variations, provided they fall within the scope of the following claims.

What is claimed is:

1. An optical element comprising:

a bottom surface;

a total reflection surface located above the bottom surface, wherein the optical element ha a central axis perpendicular to the bottom surface, and the total reflection surface extends outward from the central axis and has a peripheral boundary away from the central axis;

a recess recessed from the bottom surface toward the total reflection surface, wherein the recess has a continuously curved top surface and a continuously curved sidewall, the continuously curved top surface extends from a topmost portion thereof to an edge thereof, the continuously curved sidewall extends from the edge of the continuously curved top surface to a first edge of the bottom surface, and the recess is free of linear portions;

a first light exit surface abutting the peripheral boundary of the total reflection surface and extending toward the bottom surface away from the central axis; and a second light exit surface abutting the first light exit surface, extending away from the central axis and abutting the bottom surface, wherein each of the first light exit surface and the second light exit surface consists of at least one linear sub-refractive surface that is not perpendicular to the central axis or not parallel to the bottom surface, and each linear sub-refractive surface is a straight line in any cross section passing through the central axis, wherein the at least one linear sub-refractive surface of the second light exit surface, comprises a first linear sub-refractive surface and a second linear sub-refractive surface, each of the first linear sub-refractive surface and the second linear sub-refractive surface of the second light exit surface is not perpendicular to the central axis or not parallel to the bottom surface, each of the first linear sub-refractive surface and the second linear sub-refractive surface of the second light exit surface is straight in any cross section passing through the central axis, the second linear sub-refractive surface of the second light exit surface extends directly upwards from a second edge of the bottom surface, and at least a portion of the first linear sub-refractive surface of the second light exit surface extends directly upwards from a top edge of at least a portion of the second linear sub-refractive surface of the second light exit surface.

2. The optical element of claim 1, wherein the bottom surface has an arithmetic mean deviation greater than 0 μm.

3. The optical element of claim 1, wherein each of the linear sub-refractive surfaces has an arithmetic mean deviation greater than 0 μm, and the arithmetic mean deviations are the same as or different from each other.

4. The optical element of claim 1, wherein the at least one linear sub-refractive surface of the second light exit surface comprises a plurality of third linear sub-refractive surfaces, and the third linear sub-refractive surfaces are connected to each other in sequence from top to bottom.

5. The optical element of claim 1, wherein the at least one linear sub-refractive surface of the first light exit surface comprises a plurality of third linear sub-refractive surfaces, the third linear sub-refractive surfaces are connected to each other in order from top to bottom to connect the total reflection surface and the second light exit surface, and each of the third linear sub-refractive surfaces extends away from the central axis.

6. The optical element of claim 1, wherein the total reflection surface has a plurality of convex structures, and the convex structures are used to destroy a total reflection mechanism of the total reflection surface.

7. The optical element of claim 1, wherein at least one of the linear sub-refractive surfaces is an annular curved surface that is rotationally symmetrical with respect to the central axis.

8. The optical element of claim 1, wherein the total reflection surface is concave toward the bottom surface.

9. A light emitting device comprising:

a driving substrate;

a light emitting element disposed on the driving substrate; and the optical element of claim 1 disposed on the driving substrate, wherein the recess is used for accommodating the light emitting element.

10. The optical element of claim 3, wherein the arithmetic mean deviations of the linear sub-refractive surfaces are in a range of 0.5 μm to 40 μm.

11. The optical element of claim 4, wherein each third linear sub-refractive surface is an annular curved surface that is rotationally symmetrical with respect to the central axis, each annular curved surface has a top boundary and an opposite bottom boundary, and a length of the top boundary is less than or equal to a length of the bottom boundary.

12. The optical element of claim 4, wherein each third linear sub-refractive surface is an annular curved surface that is rotationally symmetrical with respect to the central axis, each annular curved surface has a top boundary and an opposite bottom boundary, and a first distance between the top boundary and the central axis is less than or equal to a second distance between the bottom boundary and the central axis.

13. The optical element of claim 4, wherein each third linear sub-refractive surface has an included angle with respect to the bottom surface, and the included angles are less than or equal to 90 degrees.

14. The light emitting device of claim 9, wherein the light emitting element comprises a light emitting diode.

15. The optical element of claim 13, wherein the included angles of the third linear sub-refractive surfaces gradually increase from top to bottom.

* * * * *